US005223711A

United States Patent [19]

Sanderson et al.

[11] Patent Number: 5,223,711

[45] Date of Patent: Jun. 29, 1993

[54] PLASMA SOURCES MASS SPECTROMETRY

[75] Inventors: Neil E. Sanderson, Sandiway; Christopher T. Tye, Cheadle, both of Great Britain

[73] Assignee: Fisons PLC, Ipswich, England

[21] Appl. No.: 852,159

[22] PCT Filed: Jul. 17, 1990

[86] PCT No.: PCT/GB90/01100

§ 371 Date: Mar. 31, 1992

§ 102(e) Date: Mar. 31, 1992

[87] PCT Pub. No.: WO91/02376

PCT Pub. Date: Feb. 21, 1991

[30] Foreign Application Priority Data

Aug. 1, 1989 [GB] United Kingdom ..... 8917570.7

[51] Int. Cl.[5] ..... H01J 49/02

[52] U.S. Cl. ..... 250/281; 250/282; 250/283; 250/397

[58] Field of Search ..... 250/281, 282, 283, 397

[56] References Cited

U.S. PATENT DOCUMENTS 3,260,844 7/1966 Shipley et al. .

4,695,724 9/1987 Watanabe et al. ..... 250/281

FOREIGN PATENT DOCUMENTS 2102931 4/1972 France .

OTHER PUBLICATIONS

Date et al. The Analyst, 1983 vol. 108 pp. 159-165.

Douglas et al. Prog. Anal. At. Spectros. 1985 vol. 8 pp. 1-18.

Houk Anal. Chem. 1986 vol. 58 (1) pp. 97A-105A.

Houk et al. Mass Spectrom. Rev. 1988 vol. 7u pp. 425-461.

Douglas et al. Anal. Chem. 1981 vol. 53 pp. 37-41.

Huang et al. Anal. Chem. 1987 vol. 59 pp. 2316-2320.

Jakubowski et al. Spectrochim. Acta 1988 vol. 43B pp. 1-10.

Jakubowski et al. Int. J. Mass Spectrom + Ion Proc 1986 vol. 71 pp. 1 33-197.

Nakao Rev. Sci Instrm. 1975 vol. 46 (11) pp. 1489-1492.

Kuyatt Meth. Expt. Phys. 1968 vol. 78 pp. 18-23.

Schneider et al. Nucl. Instrum. and Methods in Phys. Res. 1982 vol. 194 (1-3) pp. 387-390.

Jamba Nucl. Instrum. and Methods in Phys. Res. 1981 vol. 189 (1) pp. 253-263.

Hazelton et al. IEEE Trans. Nucl. Sci. 1979 pp. 5141-5145.

Mårtenson et al. Nucl. Instrum and Meth in Phys. Res. 1985 vol. B12 (2) pp. 273-281.

Slyusarenko et al. Instrum. and Exp. Techn. 1972 vol. 15 (4) pp. 991-992.

Herzog, et al. Adv. in Anal. Chem and Instrum 1964 vol. 3 et al. pp. 143-181.

*Primary Examiner*—Jack I. Berman

*Assistant Examiner*—Kiet T. Nguyen

*Attorney, Agent, or Firm*—Merchant & Gould, Smith, Edell, Welter & Schmidt

[57] ABSTRACT

An improved apparatus and method for plasma source mass spectrometry, the apparatus comprising: means (16) for generating a plasma (15) at substantially atmospheric pressure in a gas; means (4) for introducing a sample to the plasma wherein the sample is ionized to form sample ions (17); means (19, 23) for transmitting the ions from the plasma into an evacuated chamber (24); a mass filter (26) disposed within the evacuated chamber; a substantially non-multiplying ion detector (58) comprising an ion collector (59), the detector being responsive to the charge of at least some of the sample ions which pass through the mass filter; and means for inhibiting the response of the detector to electrically neutral particles. Typically the detector comprises a suppressor (63) and means (64) for negatively biassing the suppressor with respect to the collector, and also a shield (61) disposed to shield the suppressor from the neutral particles. Improvements include a greater dynamic range with reduced sensitivity to noise.

14 Claims, 3 Drawing Sheets

PLASMA SOURCES MASS SPECTROMETRY

This invention relates to an improved method and an improved apparatus for the analysis of samples by plasma source mass spectrometry, and particularly to inductively coupled plasma mass spectrometry (ICPMS) and to microwave induced plasma mass spectrometry (MIPMS).

In ICPMS and MIPMS a sample is ionized in a plasma torch and subsequently analyzed by mass spectrometry to determine its elemental or isotopic composition. The sample, dissolved in a solution, is introduced to the torch as an aerosol carried on a flow of inert gas where it passes into a plasma, usually maintained by induction in another flow of inert gas of the same type, typically argon at atmospheric pressure. In ICPMS the plasma is generated by electromagnetic induction from a coil disposed around the torch and energized by radio-frequency current. In MIPMS the plasma is induced in the gas in a microwave cavity coupled to a microwave energy source.

ICPMS has been reviewed, for example, by: A. R. Date and A. L. Gray in Analyst, 1983, 108, pages 159 to 165; D. J. Douglas and R. S. Houk in Progesss in Analytical and Atomic Spectroscopy, 1985, 8, pages 1 to 18; R. S. Houk in Analytical Chemistry, 1986, 58(1), pages 97A to 105A; and R. S. Houk and J. J. Thompson in Mass Spectrometry Reviews 1988, 7, pages 425 to 461. MIPMS is described by D. J. Douglas and J. B. French in Analytical Chemistry, 1981, 53, pages 37 to 41.

In ICPMS and MIPMS, the sample ions pass from the atmospheric pressure ion source, through one or more intermediate vacuum stages to a vacuum chamber where they are analyzed according to mass by a quadrupole filter. The means for detecting the mass-filtered ions usually comprises an electron multiplier either of the discrete dynode or channel type, as described in the aforementioned reviews, although a scintillator type detector is reported by L. Q. Huang et al in Analytical Chemistry, 1987, 59 pages 2316 to 2320. N. Jakubowski et al in Spectrochimica Acta, 1988, 43B, pages 1 to 10, and the International Journal of Mass Spectrometry and Ion Processes, 1986, 71, pages 183 to 197 report the use of an electron multiplier and a Faraday cup for ion detection. In such prior instruments, wherever an electron multiplier is present, it is usual to take precautions to limit extraneous influences such as visible or ultraviolet radiation, or neutral particles, to which such detectors are known to be sensitive as described by F. Nakao in the Review of Scientific Instruments 1975, 46(11), pages 1489 to 1492. Such precautions usually comprise positioning the multiplier off-axis, or alternatively, or additionally, putting a 'photon-stop' on-axis to prevent line-of-eight travel from the plasma to the electron multiplier.

SUMMARY OF THE INVENTION

Despite the success of induced plasma mass spectrometry, and particularly of ICPMS, as a technique for analyzing dissolved solids there remain certain improvements that can be made, as will be described below.

It is an object of this invention to provide an improved method for the analysis of a sample in solution by induced plasma source mass spectrometry, and particularly to provide an improved method of ICPMS or MIPMS. It is a further object to provide an improved ICP or MIP mass spectrometer. Further objects are the provision of an improved method and an improved apparatus for ion detection in mass spectrometry.

According to one aspect of the invention there is provided a method for the mass spectrometric analysis of a sample, comprising: inducing a plasma at substantially atmospheric pressure in a gas; introducing said sample to said plasma and therewith ionizing at least part of said sample to form sample ions; transmitting at least some of said sample ions into an evacuated chamber having a mass filter disposed therein, and, by means of said mass filter, selecting sample ions within a selected mass range; characterised by detecting, substantially without charge multiplication, at least some of said mass-selected ions by means of an ion detector, positioned on a straight axis extending through said mass filter, comprising an ion collector and a suppressor electrode, applying an electron-repelling voltage to said suppressor electrode and thereby returning to said collector any electrons released therefrom by particle impact, and shielding said suppressor electrode from neutral particles. The neutral particles may originate from the plasma or at some point between the plasma and detector, and may comprise atoms or molecules, possibly in a metastable state.

Also, the method preferably comprises: forming a solution of the sample; introducing the solution to a flow of carrier gas; inducing the plasma in a second flow of inert gas, preferably by radio-frequency or microwave frequency inductive coupling, and directing the carrier gas and sample into the plasma, wherein the sample is ionized.

The step of detecting ions substantially without charge multiplication preferably comprises taking from the detector an output signal composed substantially of one unit of charge for each unit of charge incident at the ion collector of the detector. The output signal thus comprises a current substantially equal to the mass-selected ion current arriving at the detector, although it may be less than the ion current by a factor related to the efficiency of the detector. The method preferably further comprises amplifying the signal current and registering it as an indication of the presence, or as a measure of the concentration, of species within the selected mass range present in the sample. The step of amplifying the signal current is carried out by electronic circuitry as distinct from the electron multiplication processes in a dynode or channel electron multiplier.

In experiments where no steps were taken to inhibit the response of a non-multiplying detector to neutral emissions, we observed a significant degree of noise interfering with sample measurements. This is surprising in that it means that the step of providing a non-multiplying detector is in itself not sufficient to ensure a satisfactorily low level of noise. For example, in a sample having cobalt as a contaminant and with the mass filter not tuned to select cobalt, we observed noise in the form of an 'offset current'. To investigate this we firstly investigated the effect of photons from the plasma. In the absence of any sample material the photon flux gave rise to no significant offset current, and increasing that flux (to a level greater than that experienced in normal measurements) produced an offset current in the opposite sense to that caused by contaminants. We deduce that the contaminant offset current noise is primarily due to neutral particles (not photons). Prior work on the sensitivity of non-multiplying detectors has concentrated on ways of reducing interference from extraneous charged particles, as reviewed for example by C. E. Kuyatt in Methods of Experimental Physics 1968, volume 78, pages 18 to 23. The significance of neutral particles in plasma source mass spectrometry, employing a non-multiplying detector, is unexpected and requires special consideration.

To implement the method it might further be thought necessary, and sufficient, to shield the collector from neutrals by such means as providing an axial stop to block direct line-of-sight transit from the plasma. Yet we have found that approach to be inappropriate, and in a preferred embodiment our method comprises applying an electron-repelling suppressor voltage to a suppressor electrode, which is a member of said detector disposed near to an entrance of said collector, and shielding that suppressor electrode from the neutral particles. In a further alternative embodiment the method comprises allowing neutral particles to enter, and subsequently to leave, the detector substantially without striking components of the detector (other than means provided for shielding particularly a suppressor electrode) and also deflecting sample ions towards the collector, in which case the method preferably comprises generating a radial electric field for accelerating sample ions away from an axis of the detector and towards a collecting surface of the collector distributed radially around that axis, while allowing neutral particles to travel undeflected along and paraxial to said axis through the detector.

According to another aspect of the invention there is provided a mass spectrometer, comprising means for generating a plasma at substantially atmospheric pressure in a gas; means for introducing a sample to said plasma wherein said sample is ionized to form sample ions; means for transmitting said ions from said plasma into an evacuated chamber; a mass filter disposed within said evacuated chamber; a substantially non-multiplying ion detector disposed on a straight axis extending through the mass filter and comprising an ion collector and a suppressor electrode, said detector being responsive to the charge of at least some of said sample ions which pass through said mass filter; means for biassing said suppressor electrode with a negative suppressor voltage with respect to said collector for reflecting towards said collector secondary electrons released therefrom; and a shield disposed for shielding said suppressor electrode from neutral particles.

Preferably the detector comprises an annular suppressor electrode defining an aperture substantially centred on an axis of the detector leading to the collector, and an annular shield electrode defining an aperture also substantially centred on the axis; wherein the suppressor electrode is disposed axially between the collector and shield electrodes. The collector is not restricted to any particular shape, and may be planar, or conical or have a convoluted surface for inhibiting the release of secondary electrons, although in a preferred embodiment the collector is generally cup-shaped, is substantially aligned on the detector axis, and has a substantially circular entrance disposed on that detector axis for receiving sample ions from the mass filter. Preferably the shield electrode aperture has a diameter less than that of the suppressor electrode aperture. Additionally the spectrometer comprises means for maintaining the suppressor voltage in a range from −50 V to −500 V, typically at −250 V, with respect to the collector and shield electrodes while maintaining these both at around ground potential. Also, one or more grounded electrostatic screening elements may be disposed around the collector, including a third electrode disposed between the collector entrance and the suppressor electrode and having an aperture (centred on the detector axis) of diameter greater than that of the collector entrance.

Thus the entrance of the ion collector may face the plasma, and the detector has an axis substantially lying on (in registration with) the mass spectrometer axis. Ions may travel along a substantially unobstructed path from the plasma to the collector, and that path may be a straight line.

In an alternative embodiment of the invention the detector comprises an entrance and an exit mutually aligned on a detector axis, and a collector spaced apart from that axis. Preferably the collector comprises an open-ended hollow cylinder with its axis centred on the detector axis. The detector may further comprise a substantially cylindrical perforated (grid or mesh) inner suppressor electrode disposed co-axially within the collector. Preferably the inner electrode is electrically biased as described above for returning to the collector any secondary electrons released therefrom by the impact of ions, and here also for accelerating sample ions away from the detector axis towards the collector. The invention also extends to an ion detector of any of the described types for use in a mass spectrometer.

In preferred embodiments the mass spectrometer comprises an ICP or MIP mass spectrometer. The sample is dissolved in a solution which is introduced, conveniently as an aerosol, in a flow of inert carrier gas, preferably argon or alternatively helium. The carrier gas flows to an ICP or MIP plasma torch wherein it meets a second flow of inert gas and a plasma is induced in the second flow, and in the carrier gas. An extraction assembly is provided for extracting ions from the plasma and transmitting them towards the mass filter. That assembly typically comprises a sample cone and a skimmer cone each having an aperture, through which the sample ions pass, lying on a linear axis of the mass spectrometer. The spectrometer preferably comprises a lens system downstream of the skimmer cone for focusing and projecting sample ions towards the mass filter. The mass filter preferably comprises a quadrupole filter having four substantially cylindrical rods arranged symmetrically about and parallel to the spectrometer axis.

BRIEF DESCRIPTION OF THE DRAWING

Preferred embodiments of the invention will now be described in greater detail, by way of example, and with reference to the figures in which.

DETAILED DESCRIPTION OF THE PREFERRED EMBODIMENT

Figure 1:
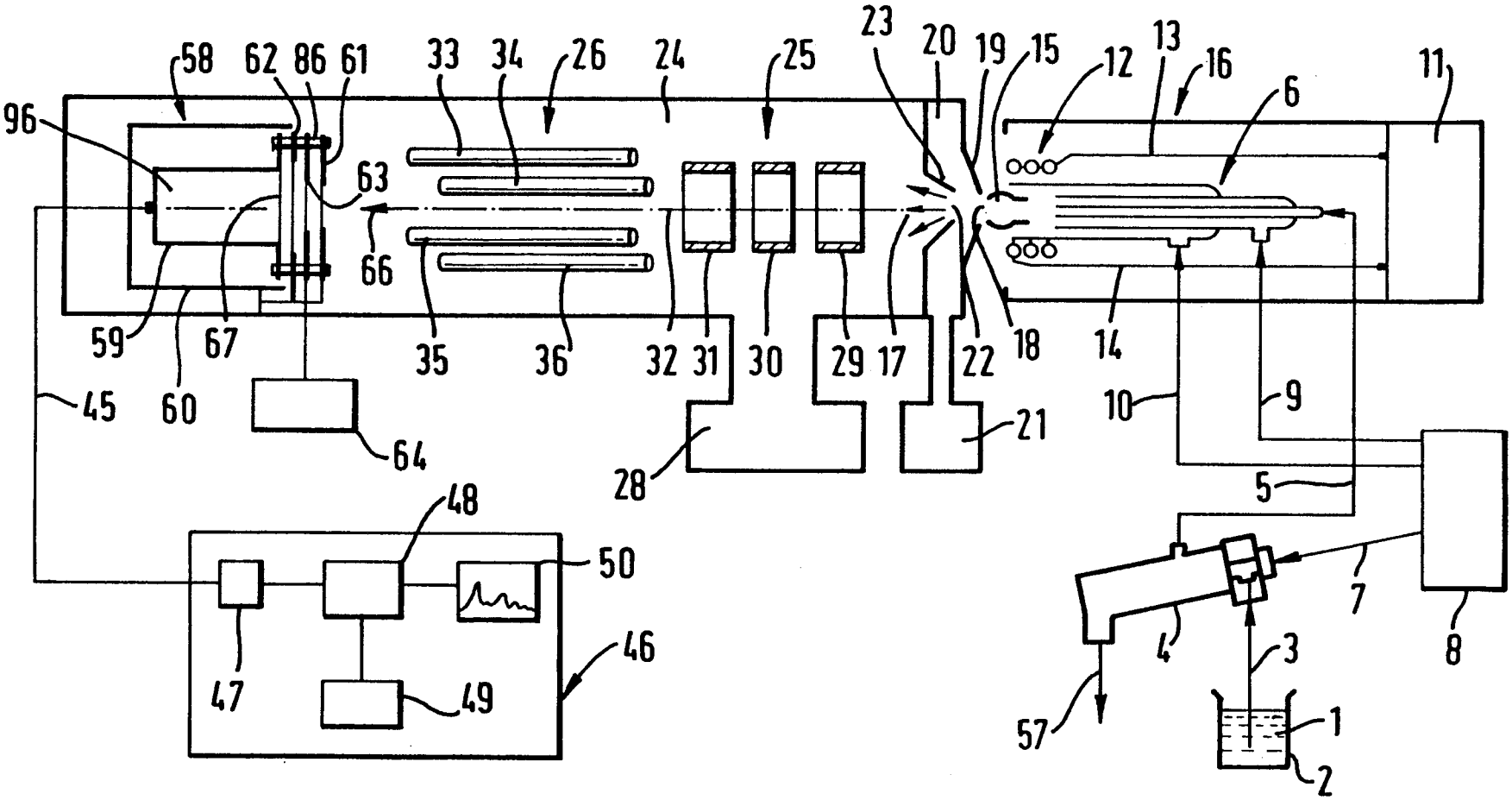
FIG. 1 illustrates a mass spectrometer according to one aspect of the invention.

Referring first to FIG. 1, a sample in a solution 1 is pumped from a container 2 along a pipe 3 to a nebulizer 4 where it is introduced to a flow of argon carrier as an aerosol, and is subsequently carried along a pipe 5 to an inductively coupled plasma ICP torch 6. Excess solution leaves nebulizer 4 through a drain 57. The carrier gas is supplied to nebulizer 4 along a pipe 7 from a reservoir 8 which also supplies a second flow and a coolant flow of argon gas to torch 6 along two additional pipes 9 and 10 respectively. A radio-frequency electrical generator 11 energizes a coil 12 via leads 13 and 14 and thereby induces a plasma 15 at the exit of the ICP torch, as will be understood from V. A. Fassel and R. N. Kniseley in Analytical Chemistry 1974, volume 46, number 13, pages 1155A to 1164A. Thus the spectrometer has a means 16 for generating a plasma 15, which in this example comprises generator 11 and torch 6 but could alternatively comprise a microwave energy source coupled to a microwave cavity.

The sample is ionized by plasma 15 and sample ions 17 are transmitted through an aperture 18 in a sampling cone 19 to a chamber 20 which is evacuated to between 0.01 torr to 10 torr (approximately 1 Pa to 130 Pa) by a pump 21. The ions 17 then pass through an aperture 22 in a skimmer cone 23 to a chamber 24 enclosing a lens system 25, a quadrupole mass filter 26 and an ion detector 58. Chamber 24 is evacuated to around or below $10^{-4}$ torr ($1.3 \times 10^{-2}$ Pa) by a pump 28 and may alternatively be subdivided by an apertured diaphragm between lens system 25 and mass filter 26 into two individually pumped chambers thereby allowing a still lower pressure (higher vacuum) to be established in the region of mass filter 26 and ion detector 27. The lens system 25 comprises three cylindrical elements 29, 30 and 31 arranged along a linear axis 32 of the mass spectrometer, and to which potentials are applied to optimize the transmission of ions 17 to mass filter 26. The mass filter 26 comprises four quadrupole rods 33,34,35 and 36 arranged parallel to, and symmetrically about, axis 32. The ion detector 58 comprises a generally cup-shaped ion collector 59 with a suppressor electrode 63 mounted near to its entrance 67 on an assembly of insulators (comprising an insulator 86 identified here as an example) which will be described in more detail later with reference to FIG. 2. The invention is not however restricted to any particular shape of collector and may alternatively comprise a planar or conical collector for example. The detector also comprises a shield electrode 61, for shielding electrode 63 from neutral particles, and electrostatic screening comprising a screen 60 and a third electrode 62. Collector 59, screen 60, and electrodes 61 and 62 are at ground potential while electrode 63 is maintained at a suppressor voltage in a range from −50 V to −500 V (typically −250 V) by a power supply 64. Ions 66, after selection according to mass by quadrupole filter 26, travel towards collector 59 which they strike, giving rise to a signal current. That current is carried on a wire 45 to a data analyzer 46 which comprises: an amplifier 47, a processor 48, a data store 49, and a display 50. With mass filter 26 set to pass ions within a selected mass range (usually restricted to one mass) the signal current indicates the presence, and concentration, of corresponding species in the sample. A spectrum is recorded by varying control voltages applied to quadrupole rods 33,34,35 and 36 and thereby sweeping the selected mass over a range of values, as will be understood.

Figure 2:
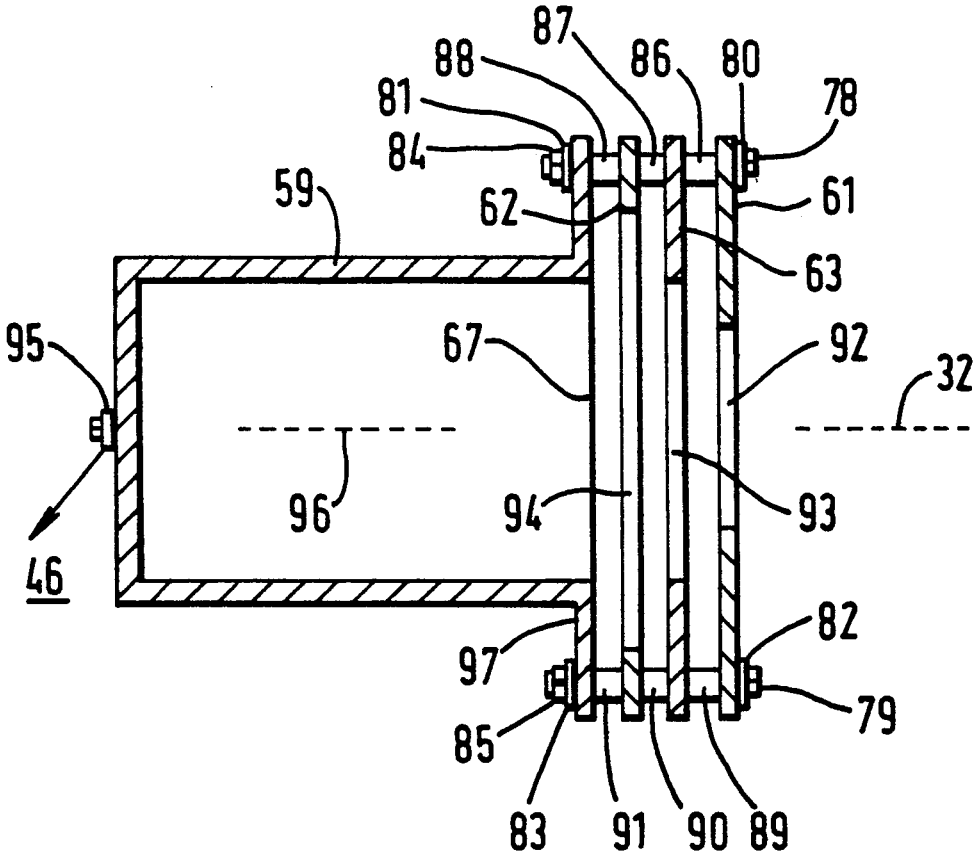
FIG. 2 illustrates an ion detector, being part of the spectrometer of FIG. 1, in greater detail.

Referring next to FIG. 2, detector 58 is illustrated in section on a larger scale to facilitate further description of its components. Outer shield 60 has been omitted for clarity of the drawing. Electrodes 61 to 63 are mounted on a flange 97 of collector 59 by means of insulating assemblies, two of which are illustrated and comprise bolts 78 and 79, washers 80 to 83, nuts 84 to 85, and ceramic insulating spacers 86 to 91. A connector 95, fixed to collector 59, allows connection through shield 60 to wire 46 (FIG. 1). The detector has a cylindrical axis of symmetry 96 which is aligned with the spectrometer axis 32. Typical, but not exclusive, dimensions for various components are as follows: shield electrode 61 defines an aperture 92 of diameter 16±2 mm; suppressor electrode 63 defines an aperture 93 of diameter 20±2 mm; third electrode 62 defines an aperture 94 of diameter 22±2 mm; and entrance 67 has a diameter of 20±2 mm. Each of the above dimensions is chosen with the conditions that the diameter of shield aperture 92 is less than that of suppressor aperture 93. Entrance 67 and apertures 92 to 94 are aligned and centred on axis 96. The separations of electrode 61 from electrode 63, electrode 63 from electrode 62, and electrode 62 from entrance 67 are each approximately 2.5 mm.

One novel feature of our invention is the step of inhibiting the response of the detector to neutral particles, the requirement for which is unexpected in a non-multiplying detector. Following realisation of that requirement it might be expected that an effective approach to noise reduction would be to prevent those particles from reaching the collector, which is the part of the detector responsive to the ion signal. However our invention is preferably implemented by preventing neutral particles reaching the suppressor, which is provided for returning to the collector any secondary electrons released therefrom by the impact of primary particles. This further aspect is again unexpected, but we have found it to be a particularly effective means of noise reduction, for example when analysing solutions containing high concentrations of certain elements, such as aluminium or thorium for example. We do not exclude the possibility that some noise may be generated as a result of neutrals striking components of the detector other than the suppressor, but we do believe that neutrals directly striking the collector itself is not a major contribution to noise. Alternatively the detector may be arranged with a collector and suppressor radially distributed about a central axis, as will be discussed with reference to FIG. 3. In each case ions may travel along a substantially unobstructed path from the plasma to the collector, where that path may be a straight line or alternatively may comprise one or more steps or changes in angle. The ions may be deflected away from a line of sight axis passing from the plasma, and concurrently or subsequently be deflected towards the collector spaced apart from that axis.

Figure 3:
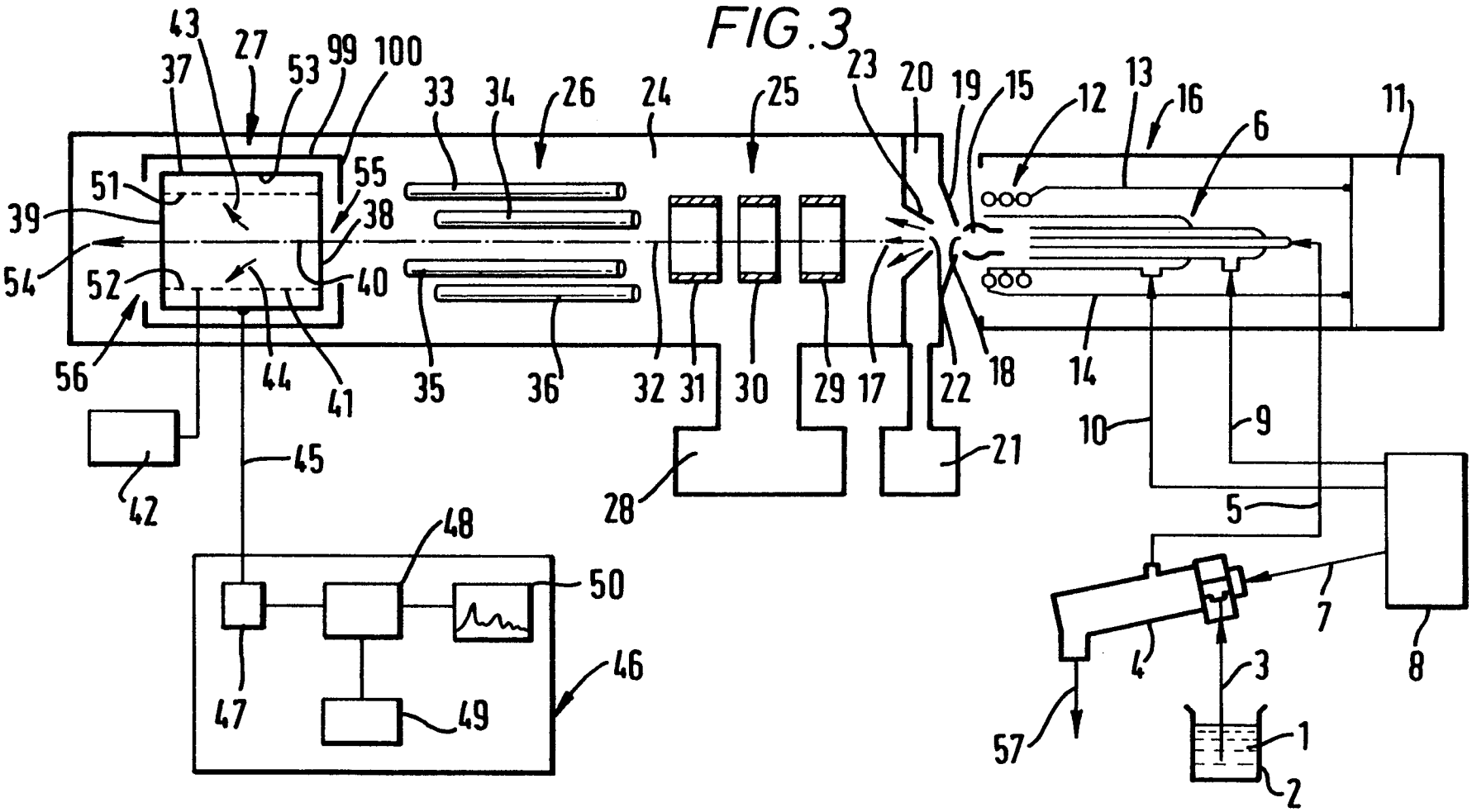
FIG. 3 illustrates an alternative mass spectrometer according to the invention.

Referring next to FIG. 3, there is shown a further alternative embodiment of the invention, comprising means for deflecting ions to an off-axis collector. An ion detector 27 comprises a hollow cylindrical collector 37 open at its ends 38 and 39, and axially centred on an axis 40 of the detector which is co-incident (in registration) with axis 32 of the mass spectrometer. Collector 37 has a diameter of about 25 mm and is 75 mm long; it is made of stainless steel, and has an inwardly facing collecting surface 53. Detector 27 also comprises a substantially cylindrical perforated inner (mesh or grid) suppressor electrode 41 disposed co-axially within collector 37. Electrode 41 has a diameter of approximately 18 mm and has mesh holes of which holes 51 and 52 are indicated as examples. Electrode 41 is maintained in a range from about −50 V to −500 V by a voltage supply 42 whereby an electric field is generated for accelerating positive ions radially away from axes 32 and 40. Those ions travel as indicated by arrows 43 and 44 towards electrode 41 and pass through its mesh holes to strike the collecting surface 53 of earthed collector 37. Neutral particles 54 travelling along and paraxial to axis 32 from plasma 18 enter detector 27 at its entrance 55 and leave at its exit 56 without striking suppressor electrode 41 (or collector 37) in any significant quantity. A further electrode 99 co-axially surrounds collector 37, acting as an electrostatic screen and having an annular face 100 which shields suppressor electrode 41 from any off-axis neutrals.

In each of the above embodiments the various components of the detector are preferably composed of stainless steel, although other materials also known to have low secondary electron emissivities such as molybdenum, gold, tantalum or carbon may alternatively be used.

The invention provides a method and apparatus for ICPMS or MIPMS at lower cost and with improved robustness and ease of servicing and construction than formerly, and with the additional advantage of greater dynamic range in terms of reduced variability in sensitivity to the mass or energy of detected species, along with reduced sensitivity to extraneous noise.

We claim:

1. A method for the mass spectrometric analysis of a sample, comprising: inducing a plasma (15) at substantially atmospheric pressure in a gas; introducing said sample to said plasma and therewith ionizing at least part of said sample to form sample ions (17); transmitting at least some of said sample ions into an evacuated chamber (24) having a mass filter (26) disposed therein, and, by means of said mass filter, selecting sample ions within a selected mass range; characterised by detecting, substantially without charge multiplication, at least some of said mass-selected ions by means of an ion detector (58,27), positioned on a straight axis extending through said mass filter, comprising an ion collector (59,37) and a suppressor electrode (63,41), applying an electron-repelling voltage to said suppressor electrode and thereby returning to said collector any electrons released therefrom by particle impact, and shielding said suppressor electrode from neutral particles.

2. A method as claimed in claim 1 and further comprising deflecting said mass selected ions towards said collector (53).

3. A method as claimed in claim 2 and further comprising generating a radial electric field for accelerating ions away from said axis of said detector (27) towards an ion-collecting surface (53) of said collector (37) distributed around said axis.

4. A mass spectrometer, comprising means (16) for generating a plasma (15) at substantially atmospheric pressure in a gas; means (4) for introducing a sample to said plasma wherein said sample is ionized to form sample ions (17); means (19,23) for transmitting said ions from said plasma into an evacuated chamber (24); a mass filter (26) disposed within said evacuated chamber; a substantially non-multiplying ion detector (58,27), disposed on a straight axis (40) extending through the mass filter and comprising an ion collector (59,37) and a suppressor electrode (63,41), said detector being responsive to the charge of at least some of said sample ions which pass through said mass filter; means (64,42) for biassing said suppressor electrode with a negative suppressor voltage with respect to said collector for reflecting towards said collector secondary electrons released therefrom; and a shield (61,100) disposed for shielding said suppressor electrode from neutral particles.

5. A mass spectrometer as claimed in claim 4 in which said detector (58) has an axis (96) leading to said collector (59) and comprises: an annular suppressor electrode (63) defining an aperture (93) substantially centred on said axis; and an annular shield electrode (61) defining an aperture (92) also substantially centred on said axis; wherein said suppressor electrode is disposed axially between said collector and said shield electrode.

6. A mass spectrometer as claimed in claim 5 in which: said axis (96) is a substantially linear axis of cylindrical symmetry; said collector (59) is generally cup-shaped, is substantially aligned on said axis, and has a substantially circular entrance (67) disposed on said detector axis for receiving said sample ions from said mass filter (26); said suppressor electrode is disposed axially between said entrance and said shield electrode; and said shield electrode aperture (92) has a diameter less than that of said suppressor electrode aperture (93).

7. A mass spectrometer as claimed in claim 6 and further comprising a third annular screening electrode (62) disposed axially between said entrance (67) and said suppressor electrode (63), which defines a third aperture (94) centred on said axis (96), and wherein said shield (61), said collector (59) and said third electrode (62) are maintained at substantially the same mutual electric potential.

8. A mass spectrometer as claimed in claim 4 in which said detector (27) has an axis of substantially cylindrical symmetry and wherein said detector comprises: said collector (37) in the form of an open-ended hollow cylinder axially centred on said detector axis, a substantially cylindrical perforated inner suppressor electrode (41) disposed co-axially within said collector; and said spectrometer has means (42) for negatively biassing said suppressor electrode (41) with a suppressor voltage with respect to said collector (37).

9. A mass spectrometer as claimed in claim 8 and comprising an annular shield electrode (100) disposed near to an entrance (38) of said collector, defining an aperture substantially centred on said detector axis (40) through which said ions may pass, and for shielding said suppressor electrode (41) from said neutral particles.

10. A mass spectrometer as claimed in claim 4 in which said collector electrode (59,37) and said shield electrode (61,100) are each substantially at ground potential and said suppressor voltage is substantially in a range of from −50 V to −500 V.

11. A mass spectrometer as claimed in claim 4 and further comprising substantially grounded electrostatic screening means (60,99) disposed around at least part of said collector.

12. A mass spectrometer as claimed in claim 4 in which said mass filter (26) comprises a quadrupole filter (33,34,35,36).

13. A mass spectrometer as claimed in claim 4 in which ions travel along a substantially unobstructed flight path from said plasma to said collector.

14. A detector (27) for ions emerging from a quadrupole mass filter (26), said detector having an axis of substantially cylindrical symmetry, and comprising: an ion collector (37) in the form of an open-ended hollow cylinder axially centred on said axis (40), a substantially cylindrical perforated inner suppressor electrode (41) disposed co-axially within said collector; wherein said inner electrode may be biassed negatively with respect to said collector, and means (100) for shielding said suppressor electrode (41) from neutral particles emerging from said mass filter (26).

* * * * *